United States Patent [19]

Yamazaki

[11] Patent Number: 4,788,435

[45] Date of Patent: Nov. 29, 1988

[54] RADIATION IMAGE STORAGE PANEL

[75] Inventor: Hisashi Yamazaki, Kaisei, Japan

[73] Assignee: Fuji Photo Film Co., Ltd., Japan

[21] Appl. No.: 878,273

[22] Filed: Jun. 25, 1986

[30] Foreign Application Priority Data

Jun. 28, 1985 [JP] Japan ..... 60-143367

[51] Int. Cl.[4] ..... H05B 33/00

[52] U.S. Cl. ..... 250/484.1; 250/327.2; 428/690

[58] Field of Search ..... 250/484.1, 327.2; 428/690

[56] References Cited

U.S. PATENT DOCUMENTS

| | | | |
|---|---|---|---|
| 4,563,580 | 1/1986 | Ishizuka et al. | 250/327.2 |
| 4,654,534 | 3/1987 | Ochiai | 250/327.2 |
| 4,665,003 | 5/1987 | Matsuda | 250/327.2 |

*Primary Examiner*—Janice A. Howell
*Assistant Examiner*—Richard Hanig
*Attorney, Agent, or Firm*—Gerald J. Ferguson, Jr.

[57] ABSTRACT

A radiation image storage panel comprising a support and a phosphor layer provided on the support which comprises a binder and a stimulable phosphor dispersed therein, characterized in that the side surfaces of said panel are covered with a polymer material composed of a linear polyester or a mixture of a linear polyester and a vinyl chloride-vinyl acetate copolymer.

5 Claims, 1 Drawing Sheet

RADIATION IMAGE STORAGE PANEL

BACKGROUND OF THE INVENTION

1. Field of the Invention

The present invention relates to a radiation image storage panel.

2. Description of the Prior Art

For obtaining a radiation image, there has been conventionally employed a radiography utilizing a combination of a radiographic film having an emulsion layer containing a photosensitive silver salt material and an intensifying screen. As a method replacing the conventional radiography, a radiation image recording and reproducing method utilizing a stimulable phosphor as described, for example, in U.S. Pat. No. 4,239,968, has been recently paid much attention. In the radiation image recording and reproducing method, a radiation image storage panel comprising a stimulable phosphor (i.e., a stimulable phosphor sheet) is used, and the method involves steps of causing the stimulable phosphor of the panel to absorb a radiation energy having passed through an object or having radiated from an object; sequentially exciting the stimulable phosphor with an electromagnetic wave such as visible light and infrared rays (hereinafter referred to as "stimulating rays") to release the radiation energy stored in the phosphor as light emission (stimulated emission); photoelectrically detecting the emitted light to obtain electric signals; and reproducing the radiation image of the object as visible image from the electric signals.

In the radiation image recording and reproducing method, a radiation image is obtainable with a sufficient amount of information by applying a radiation to an object at considerably smaller dose, as compared with the conventional radiography. Accordingly, this method is of great value especially when the method is used for medical diagnosis.

The radiation image storage panel employed in the radiation image recording and reproducing method has a basic structure comprising a support and a phosphor layer provided on one surface of the support. Further, a transparent film is generally provided on the free surface (surface not facing the support) of the phosphor layer to keep the phosphor layer from chemical deterioration or physical shock.

When the radiation image recording and reproducing method is practically carried out, the radiation image storage panel is repeatedly used in a cyclic procedure comprising steps of exposing the panel to a radiation (i.e., recording a radiation image), irradiating the panel with stimulating rays (i.e., reading out the recorded radiation image), and exposing the panel to light for erasure (i.e., erasing the remaining energy from the panel). In the cyclic procedure, the panel is transferred from a step to the subsequent step to be processed through a transfer system which includes means for holding a panel such as nip rolls.

There is a problem that mechanical shocks attack the side surfaces or edges of the panel through the transfer system so that the panel is apt to suffer abrasion, damages or stripping.

To improve the mechanical strength of the radiation image storage panel in the transfer system, a panel whose side surfaces are covered with a polymer material (and reinforced therewith) has been proposed, as disclosed in Japanese Patent Provisional Publication No. 58(1983)-68746 (corresponding to U.S. patent application Ser. No. 434,885). Since the side surfaces of the panel are covered with the polymer material composed of polyurethane or an acrylic resin, the panel is enhanced in the mechanical strength against the shocks and bending in the transfer system and prevented from the separation between the protective film and the phosphor layer thereof.

The environmental condition in the use of the radiation image storage panel tends to become severer and the radiation image recording and reproducing method requires the more improvement of the durability thereof. It is desired to enhance the resistance to shock of the panel as much as possible by using a polymer having a high adhesion with the panel and a suitable rigidity as the covering material for reinforcing the side surfaces thereof, and to further improve the durability of the panel.

SUMMARY OF THE INVENTION

An object of the present invention is to provide a radiation image storage panel which is improved in the mechanical strength such as the resistance to shock and the resistance to bending.

The object is accomplished by a radiation image storage panel of the present invention comprising a support and a phosphor layer provided on the support which comprises a binder and a stimulable phosphor dispersed therein, characterized in that the side surfaces of said panel are covered with a polymer material composed of a linear polyester or a mixture of a linear polyester and a vinyl chloride-vinyl acetate copolymer.

According to the present invention, the side surfaces of the radiation image storage panel are covered with a polymer material composed of a linear polyester, or composed of a mixture thereof with a vinyl chloride-vinyl acetate copolymer, so that the panel is prevented from suffering damages in the transferring procedure by the transfer system and improved in the durability.

More in detail, a polymer material for covering the side surfaces of the panel is required to be appropriately rigid and to have good characteristics for the covering such as coating properties and adhesion properties. The linear polyester or the mixture thereof with the vinyl chloride-vinyl acetate copolymer according to the invention satisfies these conditions. The panel whose side surfaces are covered and reinforced with said material is improved in the mechanical strength and prevented from suffering damages in the transfer system.

As a result, the use times of the panel is increased and the recording and reproducing of the radiation image is carried out reliably and in a large amount, when the radiation image storage panel of the invention is used.

BRIEF DESCRIPTION OF THE DRAWING

The sole FIGURE of the drawing is a schematic section of a radiation image storage panel according to the present invention.

DETAILED DESCRIPTION OF THE INVENTION

Figure 1:
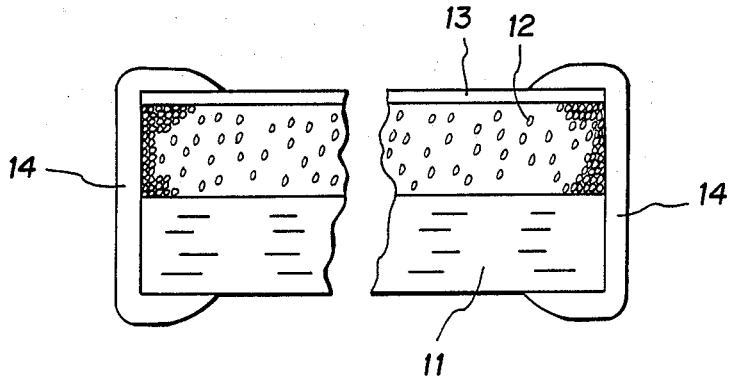

The radiation image storage panel typically comprises, as illustrated in the drawing a support 11, a phosphor layer 12 and a protective layer 13, superposed in order. According to the invention, the side surface of the panel is covered with specific polymer material 14.

The radiation image storage panel of the present invention having the above-described advantages can be prepared, for instance, in the following manner.

The radiation image storage panel basically comprises a support and a phosphor layer provided thereon, said phosphor layer comprising a binder and a stimulable phosphor dispersed therein, and the side surfaces of the panel are covered with the specific polymer material, which is a characteristic requisite of the invention.

The stimulable phosphor, as described hereinbefore, gives stimulated emission when excited with stimulating rays after exposure to a radiation. From the viewpoint of practical use, the stimulable phosphor is desired to give stimulated emission in the wavelength region of 300–500 nm when excited with stimulating rays in the wave-length region of 400–900 nm.

Examples of the stimulable phosphor employable in the radiation image storage panel of the invention include:

SrS:Ce,Sm, SrS:Eu,Sm, $ThO_2$:Er, and $La_2O_2S$:Eu,Sm as described in U.S. Pat. No. 3,859,527;

ZnS:Cu,Pb, $BaO \cdot xAl_2O_3$:Eu, in which x is a number satisfying the condition of $0.8 \leqq x \leqq 10$, and $M^{II}O \cdot xSiO_2$:A, in which $M^{II}$ is at least one divalent metal selected from the group consisting of Mg, Ca, Sr, Zn, Cd and Ba, A is at least one element selected from the group consisting of Ce, Tb, Eu, Tm, Tb, Tl, Bi and Mn, and x is a number satisfying the condition of $0.5 \leqq x \leqq 2.5$, as described in U.S. Pat. No. 4,236,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in U.S. Pat. No. 4,236,078;

$(Ba_{1-x},M^{2+}{}_x)FX:yA$, in which $M^{2+}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in U.S. Pat. No. 4,239,968;

$M^{II}FX \cdot xA:yLn$, in which $M^{II}$ is at least one element selected from the group consisting of Ba, Ca, Sr, Mg, Zn and Cd; A is at least one compound selected from the group consisting of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$ and $ThO_2$; Ln is at least one element selected from the group consisting of Eu, Tb, Ce, Tm, Dy, Pr, Ho, Nd, Yb, Er, Sm and Gd; X is at least one element selected from the group consisting of Cl, Br and I; and x and y are numbers satisfying the conditions of $5 \times 10^{-5} \leqq x \leqq 0.5$ and $0<y \leqq 0.2$, respectively, as described in Japanese Patent Provisional Publication No. 55(1980)-160078;

$(Ba_{1-x},M^{II}{}_x)F_2 \cdot aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of Zr and Sc; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 10^{-2}$, respectively, as described in Japanese Patent Provisional Publication No. 56(1981)-116777;

$(Ba_{1-x},M^{II}{}_x)F_2 \cdot aBaX_2:yEu,zB$, in which $M^{II}$ is at least one element selected from the group consisting of Be, Mg, Ca, Sr, Zn and Cd; X is at least one element selected from the group consisting of Cl, Br and I; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 2 \times 10^{-1}$, respectively, as described in Japanese Patent Provisional Publication No. 57(1982)-23673;

$(Ba_{1-x},M^{II}{}_x)F_2 \cdot aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of As and Si; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 5 \times 10^{-1}$, respectively, as described in Japanese Patent Provisional Publication No. 57(1982)-23675;

$M^{III}OX:xCe$, in which $M^{III}$ is at least one trivalent metal selected from the group consisting of Pr, Nd, Pm, Sm, Eu, Tb, Dy, Ho, Er, Tm, Yb, and Bi; X is at least one element selected from the group consisting of Cl and Br; and x is a number satisfying the condition of $0<x<0.1$, as described in Japanese Patent Provisional Publication No. 58(1983)-69281;

$Ba_{1-x}M_{x/2}L_{x/2}FX:yEu^{2+}$, in which M is at least one alkali metal selected from the group consisting of Li, Na, K, Rb and Cs; L is at least one trivalent metal selected from the group consisting of Sc, Y, La, Ce, Pr, Nd, Pm, Sm, Gd, Tb, Dy, Ho, Er, Tm, Yb, Lu, Al, Ga, In and Tl; X is at least one halogen selected from the group consisting of Cl, Br and I; and x and y are numbers satisfying the conditions of $10^{-2} \leqq x \leqq 0.5$ and $0<y \leqq 0.1$, respectively, as described in U.S. patent application Ser. No. 497,805;

$BaFX \cdot xA:yEu^{2+}$, in which X is at least one halogen selected from the group consisting of Cl, Br and I; A is at least one fired product of a tetrafluoroboric acid compound; and x and y are numbers satisfying the conditions of $10^{-6} \leqq x \leqq 0.1$ and $0<y \leqq 0.1$, respectively, as described in U.S. patent application Ser. No. 520,215;

$BaFX \cdot xA:yEu^{2+}$, in which X is at least one halogen selected from the group consisting of Cl, Br and I; A is at least one fired product of a hexafluoro compound selected from the group consisting of monovalent and divalent metal salts of hexafluoro silicic acid, hexafluoro titanic acid and hexafluoro zirconic acid; and x and y are numbers satisfying the conditions of $10^{-6} \leqq x \leqq 0.1$ and $0<y \leqq 0.1$, respectively, as described in U.S. patent application Ser. No. 502,658;

$BaFX \cdot xNaX':aEu^{2+}$, in which each of X and X' is at least one halogen selected from the group consisting of Cl, Br and I; and x and a are numbers satisfying the conditions of $0<x \leqq 2$ and $0<a \leqq 0.2$, respectively, as described in Japanese Patent Provisional Publication Ser. No. 59(1984)-56479;

$M^{II}FX \cdot xNaX':yEu^{2+}:zA$, in which $M^{II}$ is at least one alkaline earth metal selected from the group consisting of Ba, Sr and Ca; each of X and X' is at least one halogen selected from the group consisting of Cl, Br and I; A is at least one transition metal selected from the group consisting of V, Cr, Mn, Fe, Co and Ni; and x, y and z are numbers satisfying the conditions of $0<x\leqq 2$, $0<y\leqq 0.2$ and $0<z\leqq 10^{-2}$, respectively, as described in U.S. patent application Ser. No. 535,928;

$M^{II}FX\cdot aM^{I}X'\cdot bM'^{II}X''_2\cdot cM^{III}X'''_3\cdot xA:yEu^{2+}$, in which $M^{II}$ is at least one alkaline earth metal selected from the group consisting of Ba, Sr and Ca; $M^{I}$ is at least one alkali metal selected from the group consisting of Li, Na, K, Rb and Cs; $M'^{II}$ is at least one divalent metal selected from the group consisting of Be and Mg; $M^{III}$ is at least one trivalent metal selected from the group consisting of Al, Ga, In and Tl; A is metal oxide; X is at least one halogen selected from the group consisting of Cl, Br and I; each of X', X'' and X''' is at least one halogen selected from the group consisting of F, Cl, Br and I; a, b and c are numbers satisfying the conditions of $0\leqq a\leqq 2$, $0\leqq b\leqq 10^{-2}$, $0\leqq c\leqq 10^{-2}$ and $a+b+c\geqq 10^{-6}$; and x and y are numbers satisfying the conditions of $0<x\leqq 0.5$ and $0<y\leqq 0.2$, respectively, as described in U.S. patent application Ser. No. 543,326;

$M^{II}X_2\cdot aM^{II}X'_2:xEu^{2+}$, in which $M^{II}$ is at least one alkaline earth metal selected from the group consisting of Ba, Sr and Ca; each of X and X' is at least one halogen selected from the group consisting of Cl, Br and I, and $X\neq X'$; and a and x are numbers satisfying the conditions of $0.1\leqq a\leqq 10.0$ and $0<x\leqq 0.2$, respectively, as described in U.S. patent application Ser. No. 660,987;

$M^{II}FX\cdot aM^{I}X':xEu^{2+}$, in which $M^{II}$ is at least one alkaline earth metal selected from the group consisting of Ba, Sr and Ca; $M^{I}$ is at least one alkali metal selected from the group consisting of Rb and Cs; X is at least one halogen selected from the group consisting of Cl, Br and I; X' is at least one halogen selected from the group consisting of F, Cl, Br and I; and a and x are numbers satisfying the conditions of $0\leqq a\leqq 4.0$ and $0<x\leqq 0.2$, respectively, as described in U.S. patent application Ser. No. 668,464; and $M^{I}X:xBi$, in which $M^{I}$ is at least one alkali metal selected from the group consisting of Rb and Cs; X is at least one halogen selected from the group consisting of Cl, Br and I; and X is a number satisfying the condition of $0<x\leqq 0.2$, as described in Japanese Patent Application No. 60(1986)-70484.

The $M^{II}X_2\cdot aM^{II}X'_2:Eu^{2+}$ phosphor described in the above-mentioned U.S. patent application Ser. No. 660,987 may contain the following additives in the following amount per 1 mol of $M^{II}X_2\cdot aM^{II}X'_2$:

$bM^{I}X''$, in which $M^{I}$ is at least one alkali metal selected from the group consisting of Rb and Cs; X'' is at least one halogen selected from the group consisting of F, Cl, Br and I; and b is a number satisfying the condition of $0<b\leqq 10.0$, as described in U.S. patent application Ser. No. 699,325;

$bKX''\cdot cMgX''''_2\cdot dM^{III}X''''_3$, in which $M^{III}$ is at least one trivalent metal selected from the group consisting of Sc, Y, La, Gd and Lu; each of X'', X''' and X'''' is at least one halogen selected from the group consisting of F, Cl, Br and I; and b, c and d are numbers satisfying the conditions of $0\leqq b\leqq 2.0$, $0\leqq c\leqq 2.0$, $0\leqq d\leqq 2.0$ and $2\times 10^{-5}\leqq b+c+d$, as described in U.S. patent application Ser. No. 723,819;

yB, in which y is a number satisfying the condition of $2\times 10^{-4}\leqq y\leqq 2\times 10^{-1}$, as described in U.S. patent application Ser. No. 727,974;

bA, in which A is at least one oxide selected from the group consisting of $SiO_2$ and $P_2O_5$; and b is a number satisfying the condition of $10^{-4}\leqq b\leqq 2\times 10^{-1}$, as described in U.S. patent application Ser. No. 727,972;

bSiO, in which b is a number satisfying the condition of $0<b\leqq 3\times 10^{-2}$, as described in U.S. patent application Ser. No. 797,971;

$bSnX''_2$, in which X'' is at least one halogen selected from the group consisting of F, Cl, Br and I; and b is a number satisfying the condition of $0<b\leqq 10^{-3}$, as described in U.S. patent application Ser. No. 797,971;

$bCsX''\cdot cSnX'''_2$, in which each of X'' and X''' is at least one halogen selected from the group consisting of F, Cl, Br and I; and b and c are numbers satisfying the conditions of $0<b\leqq 10.0$ and $10^{-6}\leqq c\leqq 2\times 10^{-2}$, respectively, as described in Japanese Patent Application No. 60(1985)-78033; and $bCsX''\cdot yLn^{3+}$, in which X'' is at least one halogen selected from the group consisting of F, Cl, Br and I; Ln is at least one rare earth element selected from the group consisting of Sc, Y, Ce, Pr, Nd, Sm, Gd, Tb, Dy, Ho, Er, Tm, Yb and Lu; and b and y are numbers satisfying the conditions of $0<b\leqq 10.0$ and $10^{-6}\leqq y\leqq 1.0\times 10^{-1}$, respectively, as described in Japanese Patent Application No. 60(1985)-78035.

Among the above-described stimulable phosphors, the divalent europium activated alkaline earth metal halide phosphor and rare earth element activated rare earth oxyhalide phosphor are particularly preferred, because these show stimulated emission of high luminance. The above-described stimulable phosphors are given by no means to restrict the stimulable phosphor employable in the present invention. Any other phosphors can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate butyrate, polyvinyl alcohol, and linear polyester. Particularly preferred are nitrocellulose, linear polyester, polyalkyl (meth)acrylate, a mixture of nitrocellulose and linear polyester, and a mixture of nitrocellulose and polyalkyl (meth)acrylate. These binders may be crosslinked with a crosslinking agent.

The phosphor layer can be formed on the support, for instance, by the following procedure.

In the first place, stimulable phosphor particles and a binder are added to an appropriate solvent, and then they are mixed to prepare a coating dispersion comprising the phosphor particles homogeneously dispersed in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the stimulable phosphor in the coating dispersion may be determined according to the characteristics of the aimed radiation image storage panel and the nature of the phosphor employed. Generally, the ratio therebetween is within the range of from 1:1 to 1:100 (binder:phosphor, by weight), preferably from 1:8 to 1:40.

The coating dispersion may contain a dispersing agent to improve the dispersibility of the phosphor particles therein, and may contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly onto the surface of the support to form a layer of the coating dispersion. The coating procedure can be carried out by a conventional method such as a method using a doctor blade, a roll coater or a knife coater.

After applying the coating dispersion onto the support, the coating dispersion is then heated slowly to dryness so as to complete the formation of a phosphor layer. The thickness of the phosphor layer varies depending upon the characteristics of the aimed radiation image storage panel, the nature of the phosphor, the ratio between the binder and the phosphor, etc. Generally, the thickness of the phosphor layer is within the range of from 20 μm to 1 mm, and preferably from 50 to 500 μm.

The phosphor layer can be provided onto the support by the methods other than that given in the above. For instance, the phosphor layer is initially prepared on a sheet (false support) such as a glass plate, metal plate or plastic sheet using the aforementioned coating dispersion and then thus prepared phosphor layer is superposed on the genuine support by pressing or using an adhesive agent.

The support material employed in the present invention can be selected from those employed in the conventional radiographic intensifying screens or those employed in the known radiation image storage panels. Examples of the support material include plastic films such as films of cellulose acetate, polyester, polyethylene terephthalate, polyamide, polyimide, cellulose triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, one or more additional layers are occasionally provided between the support and the phosphor layer, so as to enhance the bonding between the support and the phosphor layer, or to improve the sensitivity of the panel or the quality of an image provided thereby. For instance, a subbing layer or an adhesive layer may be provided by coating polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. In the invention, one or more of these additional layers may be provided on the support.

As described in U.S. patent application Ser. No. 496,278, the phosphor layer-side surface of the support (or the surface of an adhesive layer, light-reflecting layer, or light-absorbing layer in the case where such layers provided on the support) may be provided with protruded and depressed portions for enhancement of the sharpness of the image.

On the surface of the phosphor layer, a transparent protective film may be provided to protect the phosphor layer from physical and chemical deterioration.

The transparent film can be provided onto the phosphor layer by coating the surface of the phosphor layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. Alternatively, the transparent film can be provided onto the phosphor layer by beforehand preparing it from a polymer such as polyethylene terephthalate, polyethylene, polyvinylidene chloride or polyamide, followed by placing and fixing it onto the phosphor layer with an appropriate adhesive agent. The transparent protective film preferably has a thickness within a range of approximately 0.1 to 20 μm.

The radiation image storage panel of the invention may be colored with a colorant to enhance the sharpness of the resulting image as described in U.S. Pat. No. 4,394,581 and U.S. patent application Ser. No. 326,642. For the same purpose, the phosphor layer of the radiation image storage panel may contain a white powder as described in U.S. Pat. No. 4,350,893.

Thus prepared radiation image storage panel comprising support and phosphor layer provided thereon (and protective film, if desired) is then covered on the side surfaces thereof with a specific polymer material, which is the characteristic requisite of the invention.

In the present specification, the term "side surfaces" includes those at the front and back of the panel and those at both the sides thereof, viewed along the direction in which the panel is transferred. The term "Covering the side surfaces of the panel" means that one or more side surfaces (opportunely, all the side surfaces) of the panel are covered.

The polymer materials employed in the invention is a linear polyester or a mixture of a linear polyester and a vinyl chloride-vinyl acetate copolymer.

The linear polyester is, for example, a polycondensation reaction product of dibasic acid with dioxy compound or a polycondensation reaction product of oxy acid. Examples of the dibasic acid include succinic acid, glutaric acid, adipic acid, terephthalic acid and isophthalic acid. Examples of the dioxy compound include ethylene glycol, 1,3-propanediol, 1,4-butanediol and 1,4-cyclohexane dimethanol. Examples of the oxy acid glycolic acid, lactic acid, malic acid, tartaric acid, citric acid, salicylic acid, benzoic acid, gallic acid, mandelic acid and tropic acid. The average molecular weight of the linear polyester is preferably in the range of 13,000 to 22,000.

When using the mixture of a linear polyester and a vinyl chloride-vinyl acetate copolymer, the ratio between vinyl chloride and vinyl acetate in the copolymer is decided considering the physical properties such as adhesion and rigidity. The preferred ratio therebetween is in the range of 75:25 to 97:3 (vinyl chloride:vinyl acetate, by weight). The molecular weight of the vinyl chloride-vinyl acetate copolymer is preferably in the range of 10,000 to 25,000.

The mixture ratio between the linear polyester and the vinyl chloride-vinyl acetate copolymer varies depending upon the facilitation of transfer of the panel in the transfer system. The preferred mixing ratio is in the range of 9:1 to 4:6 (linear polyester:vinyl chloride-vinyl acetate copolymer, by weight).

The covering is carried out by dissolving the above-mentioned polymer in an appropriate solvent to prepare a solution (covering solution) of the polymer and then, coating the side surfaces of the panel therewith followed by drying. The solvents employable in the covering solution include an aromatic solvent such as toluene as well as the aforementioned solvents employable for preparing the coating dispersion for the phosphor layer.

The solution whose concentration is suitably controlled is applied evenly onto the side surface of the panel to form a layer of the solution. The coating procedure can be done by a conventional method such as a spray coating method or a method using a doctor blade, a roll coater or a knife coater. Subsequently, the layer of the solution is dried to form a polymer film over the side surface of the panel.

The thickness of the polymer film varies depending upon the transferability of the resulting panel and the degree of wastage of the polymer film in the transfer system. Generally, the thickness of the dried polymer film is in the range of 2 to 100 μm, and preferably 10 to 50 μm.

For further improvement in the transferability and the resistance to damage of the radiation image storage panel, the panel may be chamfered on the edges thereof and then covered on the side surfaces thereof including the chamfered edge with the polymer material.

The chamfering can be carried out in the manner as described in the aforementioned U.S. patent application Ser. No. 496,731. The chamfering is preferably applied to the front edge of the panel (viewed along the transfer direction thereof) on the support side for facilitating transfer of the panel. It is more preferable to chamfer all edges of the panel on the support side for preventing the front surface of the panel (the phosphor layer-side surface or the protective film-side surface) from damage. It is further preferable to chamfer the edges on the phosphor layer-side as well as on the support side, so as to more improve both the transferability and the resistance to damage of the panel. The so chamfered edge may have a flat face or a curved face.

The chamfering of the edge on the support side of the panel should be preferably done in a depth within the range of 1/50 to 1/1 against the thickness of the support, measured in the direction vertical to the panel. Likewise, the chamfering of the edge on the phosphor layer-side (including a protective film when the protective film is provided thereon) of the panel should be preferably done in a depth within the range of 1/50 to 1/1 against the thickness of the phosphor layer. When the edge on the support side and the edge on the phosphor layer-side opposite to said edge are to be chamfered, the depth of at least one chamfered space is preferably adjusted to a level of less than 1/1 (against the same as above) so that the side chamfered at its both edges might not form a sharp edge.

The present invention will be illustrated by the following examples, but these examples by no means restrict the invention.

Example 1

To a mixture of a particulate divalent europium activated barium fluorobromide stimulable phosphor ($BaFBr:Eu^{2+}$) and a linear polyester resin were added successively methyl ethyl ketone and nitrocellulose (nitration degree: 11.5%), to prepare a dispersion containing the phosphor particles. Subsequently, tricresyl phosphate, n-butanol and methyl ethyl ketone were added to the dispersion. The mixture was sufficiently stirred by means of a propeller agitator to obtain a homogeneous coating dispersion having a mixing ratio of 1:10 and a viscosity of 25–35 PS (at 25° C.).

The coating dispersion was applied to a polyethylene terephthalate sheet containing titanium dioxide (support, thickness: 250 μm) placed horizontally on a glass plate. The application of the coating dispersion was done using a doctor blade. The support having a layer of the coating dispersion was then placed in an oven and heated at a temperature gradually rising from 25° to 100° C. Thus, a phosphor layer having thickness of 250 μm was formed on the support.

On the phosphor layer was placed a polyethylene terephthalate transparent film (thickness: 12 μm; provided with a polyester adhesive layer on one surface) to bond the film and the phosphor layer with the adhesive layer, to form a transparent protective film thereon. A radiation image storage panel consisting essentially of a support, a phosphor layer and a protective film was obtained.

Independently, 50 g. of a linear polyester (trade name: Staphix, available from Fuji Photo Film Co., Ltd., Japan) and a mixture solvent of 225 g. of methyl ethyl ketone and 225 g. of toluene were introduced in a polyethylene vessel. The stoppered vessel was set in a rotary dissolving machine and the mixture in the vessel was stirred to prepare a covering solution.

The panel was cut to give a rectangular sheet in a size of 30.5 cm×24.5 cm. The covering solution was applied onto the side surfaces of the rectangular panel and then the panel was sufficiently dried at room temperature, to form a polymer film having thickness of 30±3 μm thereover.

Thus, a radiation image storage panel whose side surfaces were covered with the linear polyester was prepared.

EXAMPLE 2

The procedure of Example 1 was repeated except for using 80 g. of a linear polyester (trade name: Vylon 500, available from Toyobo Co., Ltd. Japan) and 20 g. of a vinyl chloride-vinyl acetate copolymer (vinyl chloride/vinyl acetate ratio: 86/14, by weight; molecular weight: 20,000 trade name: VYHH, available from Union Carbide Corp.) in place of the linear polyester (Staphix), and 400 g. of methyl ethyl ketone as a solvent, to prepare a covering solution.

A radiation image storage panel whose side surfaces were covered with the mixture of the linear polyester and the vinyl chloride-vinyl acetate copolymer was prepared in the same manner as described in Example 1 except for using this covering solution.

EXAMPLE 3

The procedure of Example 1 was repeated except for using 75 g. of a linear polyester (Vylon 500), 25 g. of a vinyl chloride-vinyl acetate copolymer (vinyl chloride/vinyl acetate ratio: 86/14, by weight; molecular weight: 20,000; VYHH) and 2.88 g. of aliphatic polyisocyanate (crosslinking agent; trade name: Sumidule N-75, available from Sumitomo Bayer Urethane Co., Ltd., Japan) in place of the linear polyester (Staphix), and 400 g. of methyl ethyl ketone as a solvent, to prepare a covering solution.

A radiation image storage panel whose side surfaces were covered with the mixture of the linear polyester and the vinyl chloride-vinyl acetate copolymer was prepared in the same manner as described in Example 1 except for using this covering solution.

Comparison Example 1

The procedure of Example 1 was repeated except for using 60 g. of an acrylic resin (trade name: BR-90, available from Mitsubishi Rayon Co., Ltd., Japan) in place of the linear polyester (Staphix) and 440 g. of methyl ethyl ketone as a solvant, to prepare a covering solution.

A radiation image storage panel whose side surfaces were covered with the acrylic resin was prepared in the same manner as described in Example 1 except for using this covering solution.

Comparison Example 2

The procedure of Example 1 was repeated except for using 60 g. of a vinyl acetate resin (trade name: CL-13, available from Denki Kagaku Kogyo, K.K., Japan) in place of the linear polyester (Staphix) and 440 g. of methyl ethyl ketone as a solvent, to prepare a covering solution.

A radiation image storage panel whose side surfaces were covered with the vinyl acetate resin was prepared in the same manner as described in Example 1 except for using this covering solution.

The so prepared radiation image storage panels were evaluated on the transferability according to the following test.

The radiation image storage panel was introduced into a radiation image recording and reproducing apparatus and then the apparatus was drove to transfer the panel repeatedly. Every hundred times the panel was visually checked for damage. The evaluation on the transferability was done by estimating the transfer times in which damages even slightly occurred at the part of the panel provided with the polymer film as times resistant to transfer.

The results are set forth in Table 1.

TABLE 1

| | Times Resistant to Transfer |
|---|---|
| Example | |
| 1 | 3,800 |
| 2 | 4,000 |
| 3 | 4,100 |
| Com. Example | |
| 1 | 2,100 |
| 2 | 400 |

As is evident from the results set forth in Table 1, the radiation image storage panel of the invention covered with the linear polyester (Example 1) and the radiation image storage panels of the invention covered with the mixture of the linear polyester and the vinyl chloride-vinyl acetate copolymer (Examples 2 and 3) were remarkably enhanced in the durability in the transfer system, as compared with the known radiation image storage panel covered with the acrylic resin (Comparison Example 1) and the radiation image storage panel for comparison covered with another polymer material (Comparison Example 2).

Especially, the radiation image storage panel of Comparison Example 2 suffered damages on its phosphor layer inside the polymer film.

I claim:

1. A radiation image storage panel comprising a support and a phosphor layer provided on the support which comprises a binder and a stimulable phosphor dispersed therein, characterized in that the side surfaces of said panel are covered with a polymer material composed of a linear polyester or a mixture of a linear polyester and a vinyl chloride-vinyl acetate copolymer.

2. The radiation image storage panel as claimed in claim 1, in which said linear polyester has an average molecular weight ranging from 13,000 to 22,000.

3. The radiation image storage panel as claimed in claim 1, in which said polymer material is composed of the mixture of the linear polyester and the vinyl chloride-vinyl acetate copolymer, and said copolymer has a ratio between vinyl chloride and vinyl acetate in the range of 75:25 to 97:3 by weight and has a molecular weight ranging from 10,000 to 25,000.

4. The radiation image storage panel as claimed in claim 1, in which said polymer material is composed of the mixture of the linear polyester and the vinyl chloride-vinyl acetate copolymer, and the mixing ratio therebetween is in the range of 9:1 to 4:6 by weight.

5. The radiation image storage panel as claimed in claim 1, in which at least one edge on the support side of said panel is chamfered and edge faces including the chamfered edge are covered with said polymer material.

* * * * *